US006314266B1

(12) United States Patent
Murayama et al.

(10) Patent No.: US 6,314,266 B1
(45) Date of Patent: Nov. 6, 2001

(54) CLEANING APPARATUS EQUIPPED WITH BRUSH ROLLER, PROCESS CARTRIDGE, AND IMAGE FORMING APPARATUS

(75) Inventors: Kazunari Murayama, Shizuoka-ken; Hisayoshi Kojima, Mishima; Tomonori Mori, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/266,827

(22) Filed: Mar. 12, 1999

(30) Foreign Application Priority Data

Mar. 16, 1998 (JP) ..... 10-085008

(51) Int. Cl.[7] ..... G03G 21/00
(52) U.S. Cl. ..... 399/353
(58) Field of Search ..... 399/343, 349, 399/350, 353, 358, 354

(56) References Cited

U.S. PATENT DOCUMENTS

| | | | | |
|---|---|---|---|---|
| 4,297,021 | * | 10/1981 | Tani et al. | 399/358 |
| 4,327,992 | | 5/1982 | Babicz . | |
| 4,451,139 | * | 5/1984 | Yanagawa et al. | 399/350 X |
| 4,475,807 | | 10/1984 | Toyoda et al. . | |
| 4,640,608 | * | 2/1987 | Higaya et al. | 399/358 X |
| 4,664,505 | * | 5/1987 | Itaya et al. | 399/358 |
| 4,791,455 | * | 12/1988 | Yamamoto et al. | 399/353 X |
| 4,835,807 | * | 6/1989 | Swift | 399/353 X |
| 5,111,251 | * | 5/1992 | Uno et al. | 399/349 |
| 5,235,383 | | 8/1993 | Tada et al. . | |
| 5,249,026 | | 9/1993 | Kojima . | |
| 5,471,284 | | 11/1995 | Fujii et al. . | |
| 5,497,220 | | 3/1996 | Inomata et al. . | |
| 5,521,693 | | 5/1996 | Kojima et al. . | |
| 5,587,781 | * | 12/1996 | Auty et al. . | |
| 5,617,195 | * | 4/1997 | Torimaru et al. | 399/358 X |
| 5,625,443 | * | 4/1997 | Ohta et al. | 399/353 |
| 5,740,503 | * | 4/1998 | Nakamura | 399/353 X |
| 5,940,657 | | 8/1999 | Yokomori et al. | 399/119 |
| 5,950,049 | | 9/1999 | Yokomori et al. | 399/119 |
| 5,963,759 | | 10/1999 | Kojima et al. | 399/111 |

FOREIGN PATENT DOCUMENTS

| | | |
|---|---|---|
| 0 645 682 A2 | 3/1995 | (EP) . |
| 57-111577 | 7/1982 | (JP) . |
| 58-62680 | 4/1983 | (JP) . |
| 58-66981 | 4/1983 | (JP) . |
| 58-176669 | 10/1983 | (JP) . |
| 59-113473 | 6/1984 | (JP) . |
| 60-95473 | 5/1985 | (JP) . |
| 60-168183 | 8/1985 | (JP) . |
| 9-204133 | 8/1997 | (JP) . |

OTHER PUBLICATIONS

Patent Abstracts of Japan, vol. 008, No. 018 (P–250) Jan. 26, 1984 (JP–58–176669).
Patent Abstracts of Japan, vol. 007 No. 156(P–209) Jul. 8, 1983 (JP–58–066981).
Patent Abstracts of Japan, vol. 006, No. 203 (P–148) Oct. 14, 1982 (JP–57–111577).
Patent Abstracts of Japan, vol. 1997, No. 12, Dec. 25, 1997 (JP–09–204133).
Patent Abstracts of Japan, vol. 010, No. 012 (P–421) Jan. 17, 1986 (JP–60–168183).

* cited by examiner

*Primary Examiner*—Sandra Brase
(74) *Attorney, Agent, or Firm*—Fitzpatrick, Cella, Harper & Scinto

(57) ABSTRACT

A cleaning apparatus includes a brush roller, contactable to an image bearing member, for removing toner from the image bearing member and a brush driving force transmission path, which is different from a driving force transmission path for the image bearing member. The brush roller is rotated through the brush driving force transmission path with a speed of rotation smaller than that of the image bearing member.

13 Claims, 5 Drawing Sheets

CLEANING APPARATUS EQUIPPED WITH BRUSH ROLLER, PROCESS CARTRIDGE, AND IMAGE FORMING APPARATUS

FIELD OF THE INVENTION AND RELATED ART

The present invention relates to a cleaning apparatus for removing the developer remaining on the image bearing member employed by an electrophotographic image forming apparatus. It also relates to a process cartridge comprising such a cleaning apparatus, and an image forming apparatus in which such a process cartridge is removably installable.

In an image forming apparatus such as a printer, an electrostatic latent image is formed on an image bearing member (electrophotographic photosensitive member) by selectively exposing the image bearing member uniformly charged by a charging device. Then, the electrostatic latent image is developed, that is, visualized, with the use of a developing device and a developer. Then, the image composed of developer is transferred onto a recording medium. The developer remaining on the image bearing member after image transfer is removed by a cleaning blade and a brush roller to prepare the image bearing member for the following image forming rotation so that the image forming process is always carried out with the use of clean portion of the image bearing member. The removed developer is collected into a cleaning container and stored there.

In recent years, it has been made possible to simplify image formation apparatus maintenance with the use of a cartridge. According to this method, an image bearing member, a charging device, a developing device, a cleaning portion, a waste toner bin, and the like are integrated into the form of a cartridge which can be installable into the main assembly of an image forming apparatus by a user so that developer can be easily replenished or the image bearing member can be easily exchanged. Further, an image bearing member has become more durable, and the number of prints each cartridge can produce has also increased, which does not correspond with the limited developer supplying capacity of the developing device. Thus, the idea of making the developing device independent from the other components, that is, making a development cartridge completely independent from a cartridge which comprises the rest of the components, has been put to practical use. In other words, according to this idea, an image forming apparatus employs two different process cartridges: a drum cartridge, as an image formation process cartridge, integrally comprising an image bearing member, a charging device, and a cleaning portion; and a development cartridge comprising a developing device, so that not only can an image forming apparatus be easily maintained, but also two different cassettes can be replaced independently from each other according to the durability of the aforementioned main components. The waste toner, resulting from the cleaning of the photosensitive drum in a drum cartridge, is stored in the waste toner bin of the drum cartridge with a capacity large enough to store all the waste toner produced during the service life of a single image bearing member, and then is removed along with the drum cartridge as the drum cartridge is exchanged.

In the case of a brush roller for cleaning an image bearing member, it is placed in contact with an image bearing member. Therefore, the mechanism for transmitting a driving force to the brush roller, and the image bearing member, are worn by the brush roller. In other words, the usage of a brush roller is liable to reduce the service lives of the brush roller driving force transmission mechanism and the image bearing member. In order to solve this problem, the revolution of the brush roller, which comes in contact with the image bearing member, is desired to be as small as possible.

However, if a brush roller is rotated at a low revolution, toner particles become packed among the bristles of the brush, frequently varying the load which acts upon the brush roller driving force transmission mechanism. It is liable that this load fluctuation is transmitted to an image bearing member and reduces the quality of an image which is being formed.

Japanese Patent Laid-Open Application No. 176669/1983 discloses an image forming apparatus which comprises a cleaning apparatus for cleaning an electrostatic latent image bearing member. This cleaning apparatus, which is prior to the present invention, comprises a brushing member to which a positive bias is applied. In the case of this cleaning apparatus, the linear velocity Vp of the peripheral surface of the electrostatic latent image bearing member is 100 mm/sec, and the linear velocity Vb of the brushing member is 50 mm/sec. The linear velocity $V_F$ of the voltage applying means is 0 mm/sec.

However, the object of this invention disclosed in Japanese Patent Laid-Open Application No. 176669/1983 was to prevent the overall diameter of the brush from reducing. Thus, even if a brush roller were structured as disclosed in Patent Japanese Laid-Open Application No. 176669/1983, it would be impossible to prevent the fluctuation of the load generated by the brushing member from being transmitted to the electrostatic latent image bearing member.

SUMMARY OF THE INVENTION

The primary object of the present invention is to extend the service lives of an image bearing member and a brushing roller, and also to prevent the fluctuation of the load generated by a brushing roller from being transmitting to an image bearing member, so that it becomes possible to provide an image forming apparatus, a cleaning apparatus, and a process cartridge, which are capable of forming, or contributing to the formation of, images with a desirable quality for a long period of time.

Another object of the present invention is to provide an image forming apparatus, a cleaning apparatus, and a process cartridge, the number of the components of which is substantially smaller than those of the conventional ones.

Another object of the present invention is to provide a cleaning apparatus which comprises a brushing roller placed in contact with an image bearing member to remove the toner remaining on an image bearing member, and a second driving force transmission linkage, different from a first driving force transmission linkage for transmitting the driving force for driving the image bearing member, and in which the brushing roller is rotatively driven by the rotative force transmitted through the second driving force linkage, and the revolution at which the brushing roller is driven is lower than the revolution at which the image bearing member is driven, and also to provide a process cartridge and an image bearing member, which comprises such a cleaning apparatus.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The type of an image outputted from an electrophotographic image forming apparatus varies depending on the purposes for which a user is going to produce the image. In other words, not only character images but also highly precise photographic images are frequently outputted. Thus, an image forming apparatus is required to have high resolution so that it can produce highly accurate and precise images.

Therefore, in recent years, it has become common practice to employ toner composed of extremely small toner particles as a developer for image formation. Also, toner manufacturing methods have changed; methods for manufacturing microscopic toner particles have changed from mechanical methods, for example, pulverization, to chemical methods, for example, polymerization. Thus, the shape of a toner particle has changed from a multifaceted shape to a virtually spherical one.

Hereinafter, an image forming apparatus in accordance with the present invention will be described with reference to the drawings.

[General Structure]

First, the general structure of the image forming apparatus will be described with reference to FIG. 1.

Figure 1:
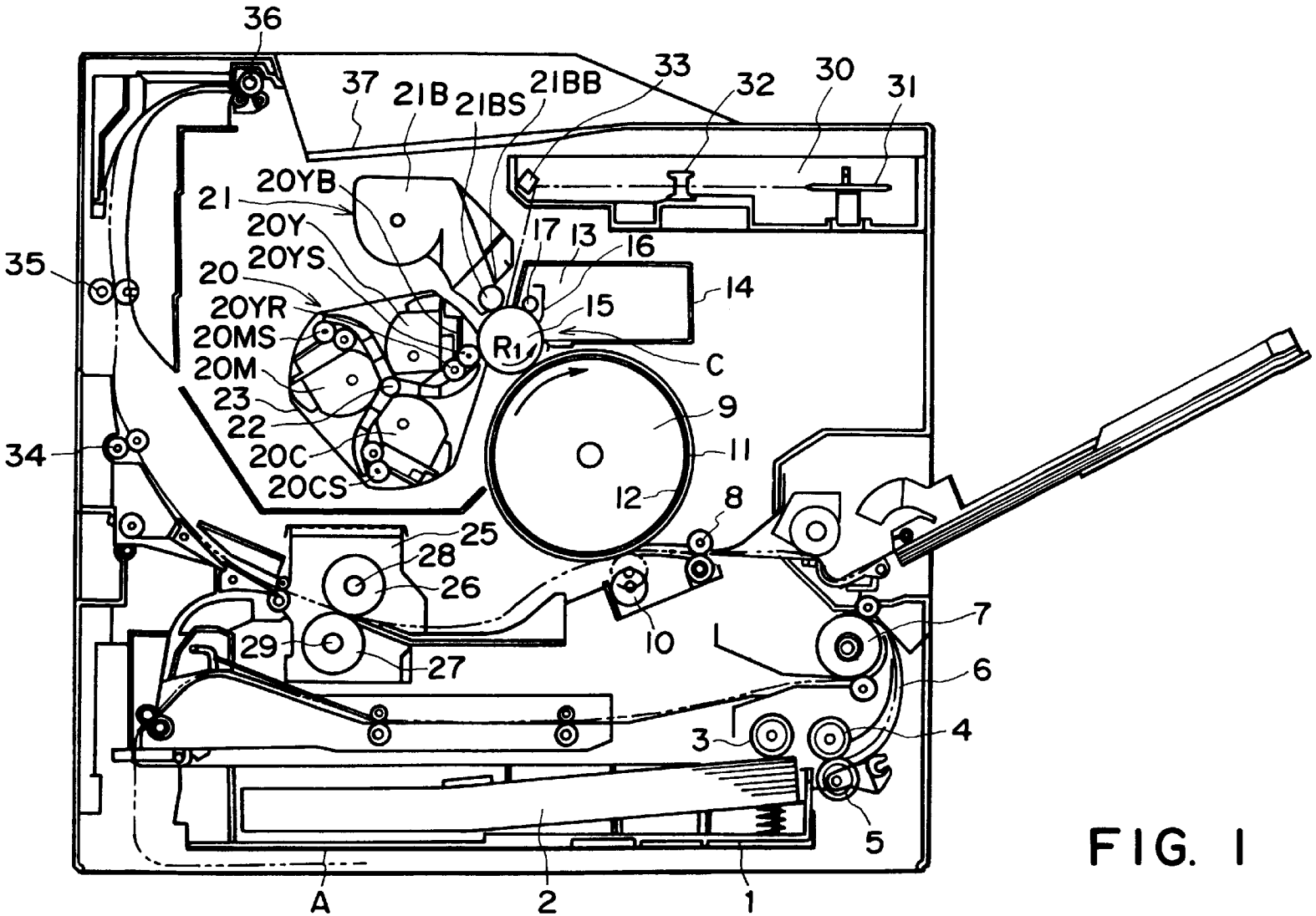
FIG. 1 is a schematic section of an image forming apparatus in accordance with the present invention, and depicts the general structure of the image forming apparatus.

FIG. 1 is a sectional drawing which depicts the general structure of a laser beam printer, a form of a color image forming apparatus as an electrophotographic image forming apparatus.

As shown in FIG. 1, the color laser printer comprises an image bearing member 15, a developing means 20 and 21, and an intermediary transferring member 9. The image bearing member 15 is an electrophotographic photosensitive member, and rotates at a constant velocity. The developing means 20 is constituted of a nonrotative black color developing device 21B, and the developing means 21 is constituted of three rotative color developing devices 20Y, 20M and 20C. The intermediary transferring member 9 temporarily bears the color images, which are developed by the developing means 20 and 21 and are transferred in multiple layers onto the intermediary transferring member 9. Then, it transfers the color image onto a piece of transfer medium 2, a recording medium, delivered from a transfer medium feeding portion 60. The transfer medium 2 onto which the color image has been transferred is next delivered to a fixing portion 25, in which the color image is fixed to the transfer medium 2. Then, the transfer medium 2 is discharged into a delivery portion 37 by discharge rollers 34, 35 and 36. The delivery portion 37 is at the top of the printer main assembly (electrophotographic image forming apparatus main assembly). The aforementioned rotative color developing devices 20Y, 20M and 20C, and the nonrotative black color developing device 21B are structured so that they can be removably installable into the printer main assembly A, independently from each other. The transfer medium feeding portion 60 and discharge rollers 34, 35 and 36 constitute a conveying means.

Next, the structure of each component of the laser printer will be described in detail in a logical order.

[Image Bearing Member Unit]

A drum cartridge 13, that is, an image bearing member unit, integrally comprises an image bearing member 15 (electrophotographic photosensitive member) and a cleaning means container 14 (waster toner collection bin). The cleaning means container 14 belongs to a cleaning apparatus C, and doubles as a holder for the image bearing member 15. The drum cartridge 13 is inserted into a cartridge space in the printer main assembly A through an unillustrated cartridge installation opening with which the printer main assembly A is provided. After the insertion, the drum cartridge 13 is removably supported by a pair of installation guides (unillustrated) as a cartridge installing means provided in the cartridge space, so that the drum cartridge 13 can be easily exchanged as a unit, according to the service life of the image bearing member 15. The image bearing member 15 in this embodiment comprises an aluminum cylinder with a diameter of approximately 60 mm, and a layer of organic photoconductive material coated on the peripheral surface of the aluminum cylinder, and is rotatively supported by the cleaning means container 14 of the cleaning apparatus C, which doubles as the holder for the image bearing member 15. Adjacent to the peripheral surface of the image bearing member 15, a cleaning blade 16 and a primary charging means 17 are disposed. The image bearing member 15 is rotated in the counterclockwise direction indicated by an arrow mark R1 in FIG. 1 in coordination with an image forming operation by transmitting a driving force from an unillustrated driving motor to one of the longitudinal ends of the image bearing member 15, that is, the unillustrated end located on the back side of the drawing

[Charging Means]

A charging means 17 is a such charging means that employs a contact-type charging method. The image bearing member 15 is uniformly charged by placing the electrically conductive roller of the charging means 17 in contact with the image bearing member 15, and then applying voltage to the electrically conductive roller.

[Exposing Means]

The image bearing member 15 is exposed by a scanner portion 30. More specifically, as image signals are given to a laser diode (unillustrated), the laser diode emits a light beam modulated with the image signals toward a polygon mirror 31, which is being rotated at a high velocity by a scanner motor (unillustrated). The light reflected by the polygon mirror 31 selectively exposes the peripheral surface of the image bearing member 15 being rotated at a constant velocity, through an image formation lens and a reflection mirror 33. As a result, an electrostatic latent image is formed on the image bearing member 15.

[Developing Means]

The developing means 20 and 21 are means for visualizing the aforementioned electrostatic latent image. The developing means 20 comprises three rotative developing devices 20Y, 20M and 20C for developing yellow color, magenta color, and cyan color, correspondingly, and the developing means 21 comprises one black color developing device 21B.

The black color developing means 21B is an immobile device, and is disposed facing the peripheral surface of the image bearing member 15 so that the distance between the peripheral surfaces of the image bearing member 15 and the sleeve 21BS of the black color developing means becomes microscopically small (300 μm). It forms a visible image on the image bearing member 15 with the use of black toner.

In the black color developing device 21B, the toner is sent to the sleeve 21BS by a toner sending mechanism (unillustrated), and is coated in a thin layer on the peripheral surface of the sleeve 21BS which is rotating in the illustrated clockwise direction, by a toner coating blade 21BB pressed upon the peripheral surface of the sleeve 21BS. While the toner is coated on the sleeve 21BS by the blade 21BB, the toner is triboelectrically charged. As a development bias is applied to the sleeve 21BS, the electrostatic latent image on the image bearing member 15 is developed into a toner image corresponding to the electrostatic latent image.

Each of three rotative color developing devices 20Y, 20M and 20C is removably supported by a development rotary device 23 which rotates about a shaft 22. During an image forming operation, each of the color developing devices 20Y, 20M and 20C rotates about the shaft 22 while being held by the development rotary device, and stops at a predetermined developing station where it squarely faces the image bearing member 15, holding a microscopic distance (approximately 300 μm) from the image bearing member 15, and develops the electrostatic latent image on the image bearing member 15, into a visible image. During a color image forming operation, the development rotary device 23 rotates a predetermined distance per each full rotation of the intermediary transferring member 9, positioning the yellow color developing device 20Y, the magenta color developing device 20M, and the cyan color developing device 20C, at the developing station, in the listed order, to carry out the development process, and thereafter, the development process is carried out by the black color developing device 20B.

FIG. 1 shows a state in which the yellow color developing rotative device 20Y is positioned at the developing station where it faces the drum cartridge 13. The rotative developing device 20Y sends the toner in the container to a coating roller 20YR by a toner sending mechanism (unillustrated). Then, the toner is coated in a thin layer on the peripheral surface of the sleeve YS, which is rotating in the illustrated clockwise direction, by the coating roller 20YR, which rotates in the illustrated clockwise direction, and the blade 20YB is pressed upon the peripheral surface of the sleeve 20YS. While being coated, the toner is triboelectrically charged. The electrostatic latent image formed on the image bearing member 15 is developed into a toner image corresponding to the latent image by applying a development bias to the sleeve 20YS, which is squarely facing the image bearing member 15. The magenta color developing device 20M and the cyan color developing device 20C also carry out their own toner based development processes, through the same mechanism as the above described one.

As each of the rotative developing devices 20Y, 20M and 20C is positioned at the developing station, each of the sleeves 20YS, 20MS and 20CS of the devices 20Y, 20M and 20C, correspondingly, is connected to its own color development high voltage power source and driving means (both unillustrated), and voltage is sequentially and selectively applied to a pertinent developing device while the developing device is driven.

[Intermediary Transferring Member]

During a single cycle of image forming operation, an intermediary transferring member 9 receives from different toner images, that is, a yellow color image, a magenta color image, a cyan color image, and a black color image, which are transferred from the image bearing member 15 on which these color images are developed by the developing devices 20Y, 20M, 20C and 20B. In order to receive these color images, the intermediary transferring member 9 synchronously rotates in the illustrated clockwise direction at the same peripheral velocity as the image bearing member 15. After the receiving of the four images of different colors by the intermediary transferring member 9, a piece of recording medium 2 is conveyed while being pinched between a transfer roller 10, to which voltage is being applied, and the intermediary transferring member 9. As a result, the four images of different colors on the intermediary transferring member 9 are simultaneously transferred onto the recording medium 2.

The intermediary transferring member 9 in this embodiment comprises an aluminum cylinder 12 with a diameter of 180 mm, and an elastic layer 11 which covers the peripheral surface of the aluminum cylinder 12. The material of the elastic layer 11 is sponge, rubber, or the like, the electrical resistance of which is in an intermediate range. The intermediary transferring member 9 is rotatively supported and is rotated by the driving force transmitted through a gear (unillustrated) integrally attached to the intermediary transferring member 9.

[Cleaning Container]

Figure 2:
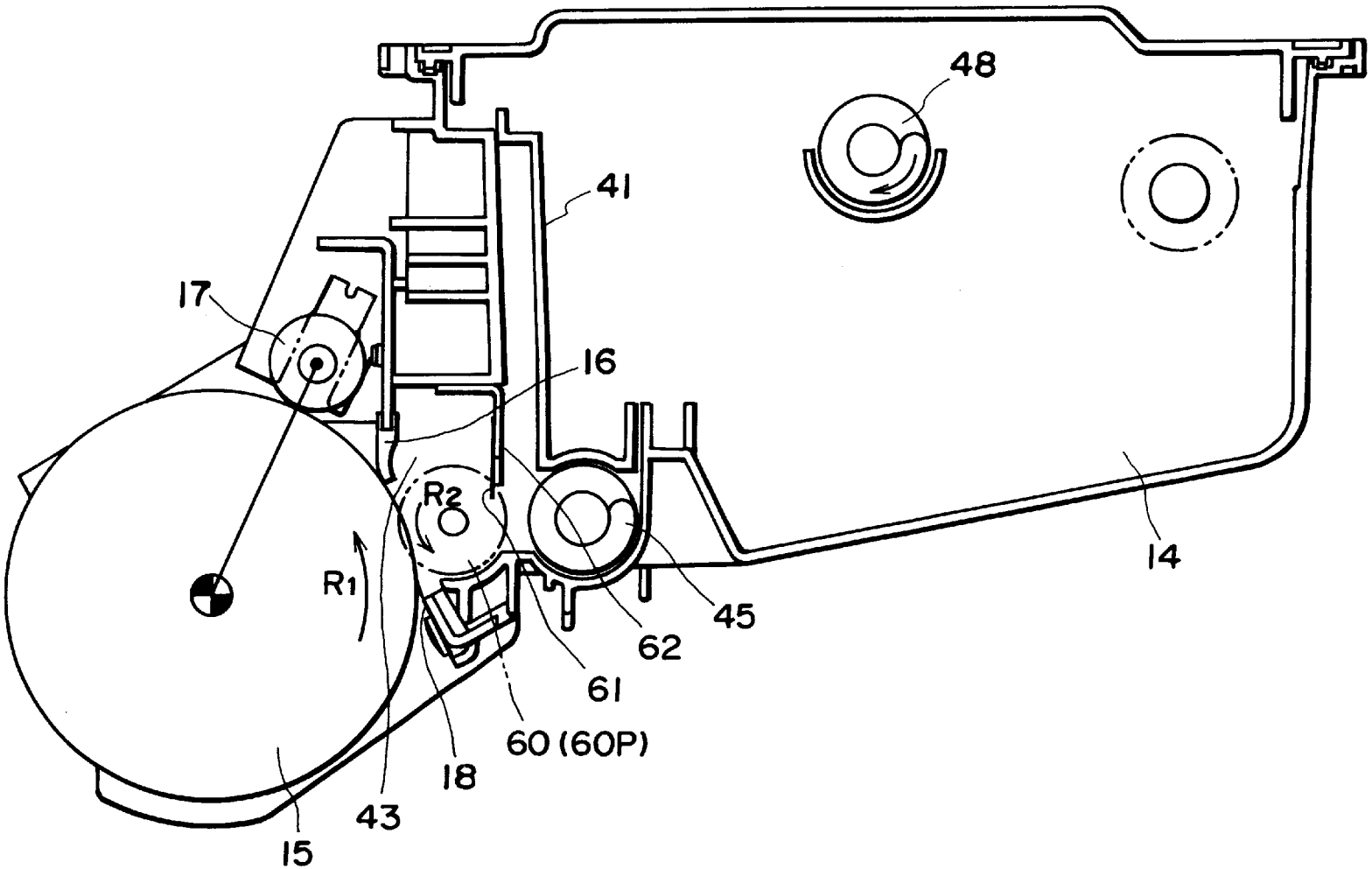
FIG. 2 is a schematic section of a process cartridge compatible with the image forming apparatus illustrated in FIG. 1.
Figure 4:
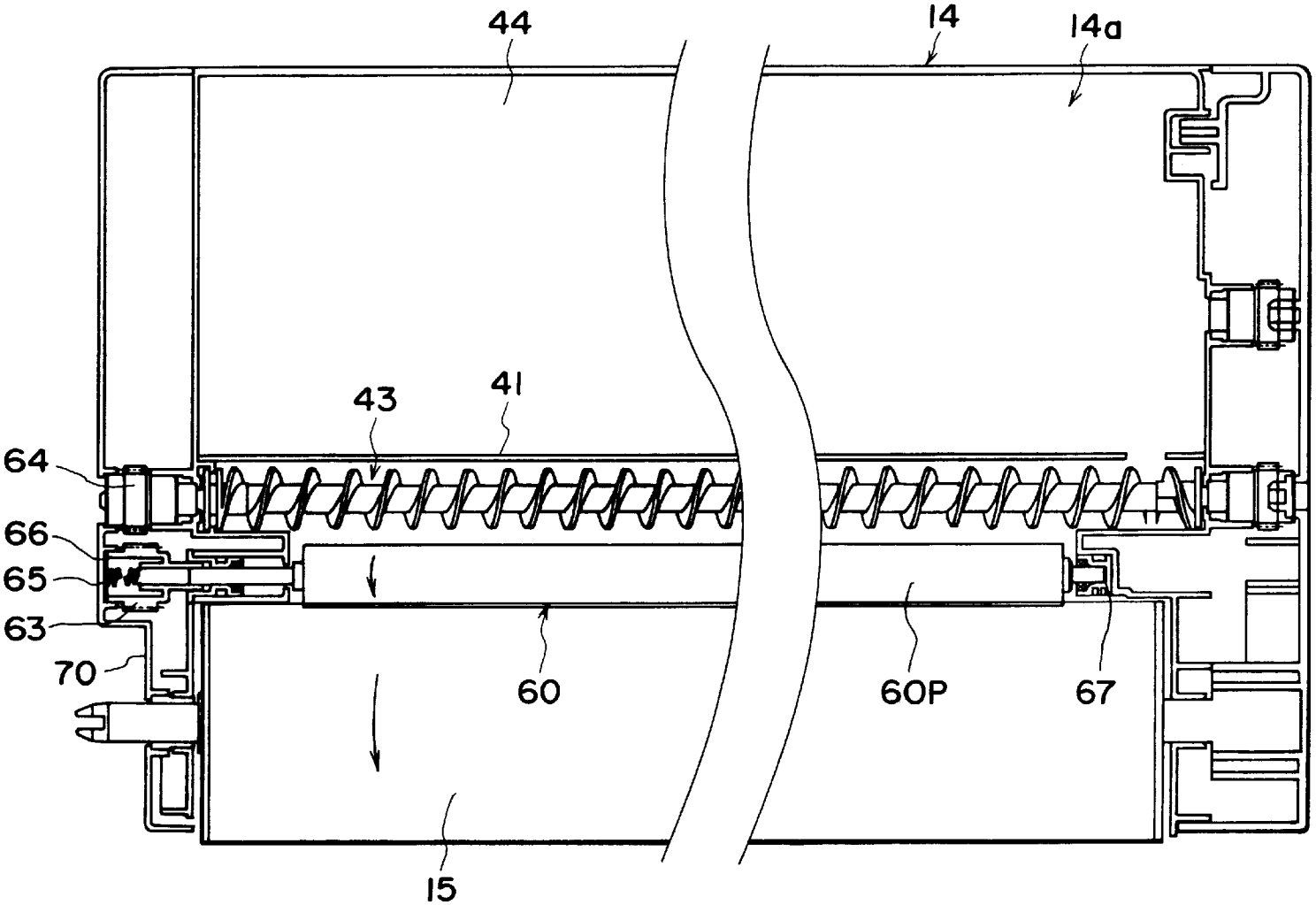
FIG. 4 is a horizontal section of the process cartridge illustrated in FIG. 2.

The cleaning apparatus C as the cleaning means is an apparatus for cleaning the image bearing member 15, that is, removing the toner particles remaining on the image bearing member 15, after the visual images, or the toner images, which are developed on the image bearing member 15 by the developing means 20 and 21, are transferred onto the intermediary transferring member 9. The removed toner, or the waste toner, is collected into the cleaning means container 14. The amount of the waste toner collected into the cleaning means container 14 is not large enough to fill the cleaning means container 14 before the expiration of the service life of the image bearing member 15. Thus, the cleaning means container 14 is replaced at the same time as the image bearing member 15 is replaced at the end of its service life. Referring to FIGS. 2 and 4, the cleaning means container 14 is provided with a separation wall, which is located in the internal space 14*a* of the cleaning means container 14 to separate the space 14*a* into two chambers, that is, a cleaning chamber 43 and a waste toner accumulation chamber 44, so that the cleaning process is not adversely affected by the backflow of the waste toner. The structure of the cleaning means will be described later in detail.

[Sheet Feeding Portion]

The sheet feeding portion 60 is a portion for conveying the recording medium 2 to a transfer portion, and basically comprises a cassette 1, a sheet feeding roller 3, a conveyer roller 4, a retard roller 5, a sheet feeding guide 6, and a registration roller 8. The cassette 1 contains a plurality of sheets of recording medium 2. The retard roller 5 prevents two or more sheets from being fed at the same time. In an image forming operation, the sheet feeding roller 3 is rotatively driven in coordination with the progress of the image forming operation, feeding the recording medium sheets 2 in the cassette 1 out of the cassette 1 one by one while separating them. After being fed out of the cassette 1, each sheet of recording medium 2 is guided by the sheet guiding member 6, along the conveying roller 7, to the registration roller 8. The registration roller 8 carries out a predetermined sequence comprising a period in which the roller 8 is kept still to keep the recording medium 2 on standby, and a period in which the roller 8 is rotated to convey the recording medium 2 to the intermediary transferring member 9, so that the recording medium 2 is accurately aligned with the image when the image is transferred onto the recording medium 2 during the following step, that is, the image transferring step.

[Transferring Portion]

The transferring portion comprises the transfer roller 10 which takes two distinctive positions.

The transfer roller 10 comprises a metallic shaft, and an elastic layer wrapped around the metallic shaft. The elastic layer is formed of foamed material with an intermediate electrical resistance. It is placed at the top position or the bottom position, and can be rotatively driven. While four toner images of different colors are formed on the intermediary transferring member 9, that is, while the intermediary transferring member 9 is rotated a plural number of times, the transfer roller 10 is kept at the bottom position outlined by a solid line in FIG. 1, being separated from the intermediary transferring member 9, so that the images on the intermediary transferring member 9 are not disturbed. After all four toner images of different colors are formed on the intermediary transferring member 9, the transfer roller 10 is moved to the top position outlined by a fine line in FIG. 1, in synchronism with the transfer timing for the color image composed of the four toner images of different colors, by an unillustrated cam member, being thereby pressed upon the intermediary transferring member 9 so that a predetermined amount of contact pressure is generated between itself and the intermediary transferring member 9 while pinching the recording medium 2 between itself and the intermediary transferring member 9. At the same time, bias is applied to the transfer roller 10, and the toner image on the intermediary transferring member 9 is transferred onto the recording medium 2. Since the intermediary transferring member 9 and transfer roller 10, which are pinching the recording medium 2, are both driven, as soon as the transferring step ends, the recording medium 2 is conveyed at a predetermined velocity in the illustrated leftward direction toward a fixing device 25 which carries out the next step.

[Fixing Portion]

The fixing device 25 fixes the toner image, which is formed by the aforementioned developing means 20 and 21 and transferred onto the recording medium 2 by way of the intermediary transferring member 9, to the recording medium 2. As shown in FIG. 1, the fixing device 25 comprises a fixing roller 26 for applying heat to the recording medium 2, and a pressure roller 27 for pressing the recording medium 2 upon the fixing roller 26. Both rollers 26 and 27 are hollow, and contain heaters 28 and 29, respectively, in their internal spaces. As they are rotatively driven, they convey the recording medium 2 forward while fixing the image to the recording medium 2.

In other words, the recording medium 2, which is bearing the toner image, is conveyed by the fixing roller 26 and pressure roller 27 while the toner image is fixed to the recording medium 1 by the heat and pressure applied to the recording medium 2.

[Cleaning Means (Cleaning Apparatus)]

Referring to FIG. 2 to FIG. 5, the structure of the cleaning apparatus C will be described in detail.

Referring to FIG. 2, the cleaning apparatus C has a cleaning blade 16 as a cleaning member, and a brush roller 60. The cleaning blade 16 is for scraping off the toner, which remains on the image bearing member 15, into the cleaning means container 14. The brush roller 60 is a scraping member for scraping off the toner from the image bearing member 15. It is disposed in contact with the image bearing member 15, on the upstream side of the cleaning blade 16 in terms of the rotational direction of the image bearing member 15, in such a manner that the pile portion 60P, which will be described later, would theoretically invade the peripheral surface of image bearing member 15 approximately 1 mm. The brush roller 60 is rotated in the direction indicated by an arrow mark R2. In other words, in the interface between the brush roller 60 and the image bearing member 15, the peripheral surface of the brush roller 60 moves in the direction opposite to the image bearing member 15.

Referring to FIG. 4, the brush roller 60 has a brushing pile portion 60P as a portion for scraping the toner off from the image bearing member 15. The brush roller 60 comprises a brush shaft 60S, and a piece of pile wrapped around the brush shaft 60S. The brush shaft 60S is formed of electrically conductive metallic material. The pile in this embodiment is made of electrically conductive fiber. The brush roller 60 with the electrically conductive pile portion 60P is grounded to the metallic grounding plate 66 to remove the charge which the toner on the image bearing member 15 has accumulated, because the toner, from which electrical charge has been removed, is easier to separate from the peripheral surface of the image bearing member 15, and therefore, is more effectively removed by the cleaning blade 16. The metallic grounding plate 66 will be described later.

Again referring to FIG. 4, the force for driving the brush roller 60 is transmitted to a driving gear 64 within the CRG (cartridge) through a coupling (unillustrated) and a driving force transmission path, different from the driving force transmission path for the image bearing member 15. The driving force transmitted to the gear 64 is transmitted to a brush gear 63 by way of an unillustrated idler gear train, and rotates the brush roller 60. In other words, the driving force transmission path for the brush roller 60 includes the driving force input path for the screw 45 as illustrated in FIG. 4. While the image bearing member 15 is rotated at a revolution of 36 rpm, the brush roller 60 is rotated at a revolution of 33 rpm, which is smaller than that of the image bearing member 15.

Since the revolution of the brush roller 60 is small, the brush shaft bearing 68, which is located in the cleaning means container 14, on the driving side, to support the brush driving gear train (unillustrated) is prevented from excessively wearing, and also, the brush roller 60 scrapes off the toner more effectively. In other words, it is guaranteed that the brush roller 60 can be flawlessly rotated until the end of the long service life of the image bearing member 15.

Figure 5:
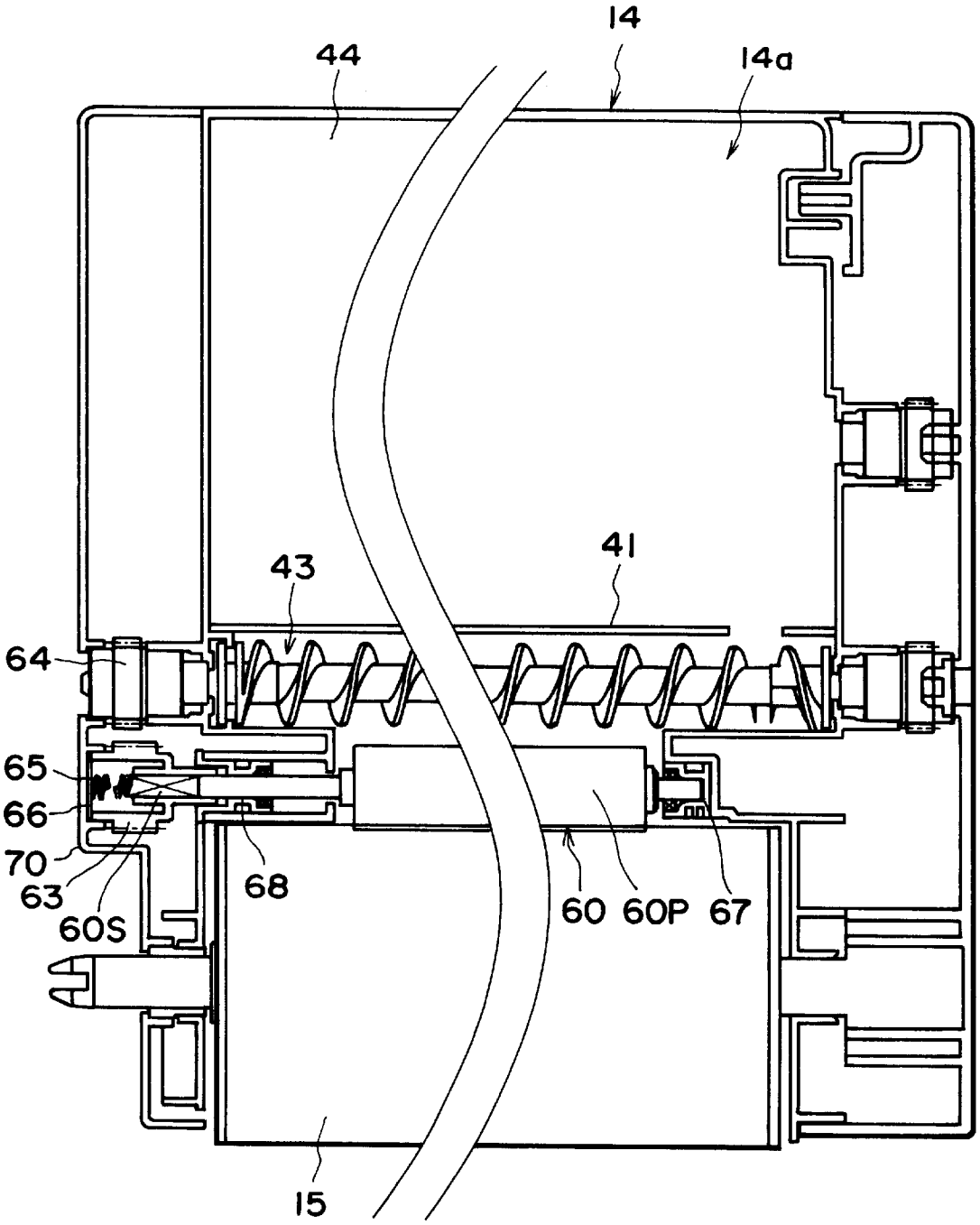
FIG. 5 is an enlarged horizontal section of the process cartridge illustrated in FIG. 2.

Next, referring to FIGS. 4 and 5, there is positioned a coil spring 65, being slightly compressed, between the cartridge frame wall and the driving side end, that is, the sliding contact point side, of the brush shaft 60S. The coil spring 65 is a compression spring formed of electrically conductive material and is wound in such a direction that it tightens as the brush shaft 60S is rotated. With the presence of the coil spring 65, the other end, that is, the nondriven side end, of the brush shaft 60S is pressed against a brush shaft bearing 67, assuring that the brush roller 60 is accurately positioned relative to the cleaning means container 14. The driving side end of the brush shaft 60S of the brush roller 60 is electrically connected to the metallic grounding plate 66 through the coil spring 65 so that it remains electrically connected to the metallic grounding plate 66 even while the brush roller 60 is rotated. In other words, the resiliency of the properly compressed coil spring 65 assures good electrical conductivity.

Figure 3:
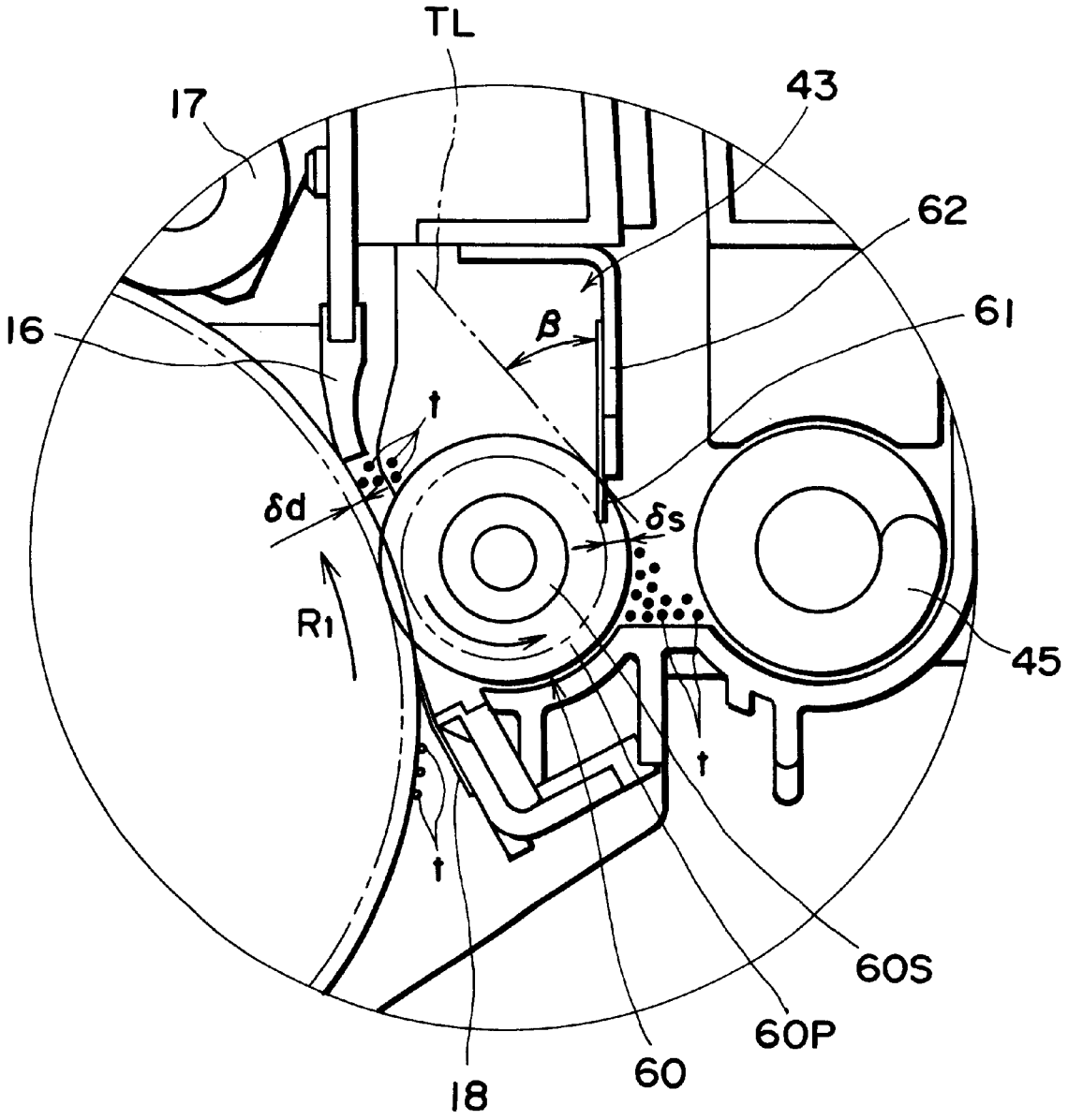
FIG. 3 is an enlarged section of the cleaning chamber of the cleaning container in the process cartridge illustrated in FIG. 2.

FIG. 3 is an enlarged sectional view of the cleaning chamber 43.

In FIG. 3, a reference character 61 designates a flexible sheet as a scraping member. The flexible sheet 61 is pasted to a metallic scraper plate 62 located in the cleaning chamber 43. It is extended in the direction opposite to rotational direction of the brush roller 60, and its tip is placed in contact with the pile portion 60P of the brush roller 60. In other words, the free end of the flexible sheet 61 is on the upstream side of the fixed end of the flexible sheet 61 in terms of the rotational direction of the brush roller 60. The flexible sheet 61 in this embodiment is formed of 0.1 mm thick PET (polyethyleneterephthalate). However, the material for the flexible sheet 61 does not need to be limited to a PET sheet. Any reasonably flexible sheet, for example, SUS sheet may be used.

The flexible sheet 61 is placed in contact with the pile portion 60P so that the angle β (contact angle) formed by the flexible sheet 61 and the line drawn tangential to the peripheral surface of the pile portion 60P through the imaginary crossing point between the flexible sheet 61 and the peripheral surface of the pile portion 60P becomes 40 deg., satisfying the requirement pertaining to the contact angle between the brush roller 60 and the flexible sheet 61: $\beta<45$ deg. The amount of the theoretical invasion δd (contact invasion) of the pile portion 60P into the image bearing member 15 is 1.0 mm ($\delta d=1.0$ mm), whereas the amount of the theoretical invasion δs of the flexible sheet 61 into the pile portion 60P is 1.5 mm ($\delta s=1.5$ mm), satisfying the requirement pertaining to the relationship between the amount of the theoretical invasion δd of the brush roller 60 into the image bearing member 15 and the amount of the theoretical invasion δs into the brush roller 60: $\delta d<\delta s$.

Since the angle β of the flexible sheet 61 relative to the peripheral surface of the pile portion 60P of the brush roller 60 is smaller than 45 deg., even if the flexible sheet 61 is flexed by the rotation of the brush roller 60, the flexible sheet 61 remains extended in the direction opposite to the rotational direction of the brush roller 60, in contact with the brush roller 60, being enabled to effectively scrape out the toner which has entered the pile portion 60P of the brush roller 60. If the flexible sheet 61 is set so that the angle β of the flexible sheet 61 relative to the brush roller 60 becomes more than 45 deg., the flexible sheet 61 is liable to be excessively flexed by the rotation of the brush roller 60. In other words, the flexible sheet 61 is liable to be flexed so much that the tip portion of the flexible sheet 61 becomes pointed in the same direction as the rotational direction of the brush roller 60, pressing down the toner, which has entered the pile portion 60P of the brush roller 60. Therefore, the flexible sheet 61 fails to effectively scrape out the toner from within the pile portion 60P. Thus, it is desired that the contact angle β is set to be more than 45 deg.

Further, the fact that the amount δs of the theoretical invasion of the flexible sheet 61 into the brush roller 60 is greater than the amount δd of the theoretical invasion of the brush roller 60 into the image bearing member 15 means that the capacity of the flexible sheet 61 in terms of scraping off the toner at the contact between the flexible sheet 61 and the brush roller 60 is greater than the capacity of the brush roller 60 in terms of scraping off the toner from the peripheral surface of the image bearing member 15, assuring that the toner continuously scraped off from the image bearing member 15 by the brush roller 60 is completely and continuously scraped off from the brush roller 60 by the flexible sheet 61 at the interface between the brush roller 60 and flexible sheet 61.

Next, referring to FIG. 3, the process for removing the toner which remains on the image bearing member 15 after image transfer will be described.

After image transfer, as the image bearing member 15 rotates, the residual toner t, that is, the toner remaining on the peripheral surface of the image bearing member 15, enters the cleaning means container 14 past a scooping sheet 18. In the cleaning means container 14, the residual toner t on the image bearing member 15 is scraped off from the image bearing member 15 at the contact between the image bearing member 15 and the brush roller 60 by the pile portion 60P of the brush roller 60 which is rotating in the direction opposite to the rotational direction of the image bearing member 15. The residual toner t scraped off from the image bearing member 15 by the brush roller 60 enters the gaps among the fibers in the pile portion 60P of the brush roller 60.

Since the brush roller 60 is electrically conductive and is electrically connected to the grounding plate 66 through the coil spring 65, the electrical charge which the residual toner t on the image bearing member 15 has collected is discharged, making it easier for the residual toner t on the image bearing member 15 to be separated from the peripheral surface of the image bearing member 15. Therefore, the residual toner t remaining on the image bearing member 15 past the brush roller 60 can be more effectively removed by the cleaning blade 16 during the next cleaning step.

As the image bearing member 15 further rotates, the residual toner t, which failed to be scraped off by the brush roller 60, reaches the cleaning blade 16, and is scraped off from the image bearing member 15 by the cleaning blade 16, entering the gaps among the fibers in the pile portion 60P of the brush roller 60.

As the brush roller 60 turns, the residual toner t which entered the gaps among the fibers in the pile portion 60P of the brush roller 60 is carried past the interface between the brush roller 60 and image bearing member 15, and is scraped out of the gaps among the fibers in the pile portion 60P of the brush roller 60 by the flexible sheet 61.

Since the angle β of the flexible sheet 61 relative to the peripheral surface of the pile portion 60P of the brush roller 60 is smaller than 45 deg., even if the flexible sheet 61 is flexed by the rotation of the brush roller 60, the flexible sheet 61 remains extended in the direction opposite to the rotational direction of the brush roller 60, in contact with the brush roller 60, being enabled to effectively scrape out the residual toner t which has entered the gaps among the fibers in the pile portion 60P of the brush roller 60. Further, the fact that the amount δs of the theoretical invasion of the flexible sheet 61 into the brush roller 60 is greater than the amount δd of the theoretical invasion of the brush roller 60 into the image bearing member 15 means that the capacity of the flexible sheet 61 in terms of scraping off the toner at the contact point between the flexible sheet 61 and the brush roller 60 is greater than the capacity of the brush roller 60 in terms of scraping off the toner from the peripheral surface of the image bearing member 15, assuring that the toner continuously scraped off from the image bearing member 15 by the brush roller 60 is completely and continuously scraped off from the brush roller 60 by the flexible sheet 61 at the interface between the brush roller 60 and flexible sheet 61.

The residual toner t which was scraped out by the flexible sheet 61 falls onto a screw 45 which is rotating behind the brush roller 60, and is sent into the waste toner accumulation chamber 44 by the screw 45.

After being scraped off from the image bearing member 15 by the cleaning blade, the residual toner t falls onto the pile portion 60P of the brush roller 60 and enters the gaps among the fibers in the pile portion 60P, as described above. Then, it passes the interface between the brush roller 60 and image bearing member 15 as the brush roller 60 rotates.

Then, it is scraped out of the pile portion 60P of the brush roller 60 by the flexible sheet 61. Therefore, the amount of the residual toner t which remains on the peripheral surface of the image bearing member 15, across the area between the brush roller 60 and cleaning blade 16, is minimized, assuring that virtually the entire residual toner t which reaches the cleaning blade 16 is removed by the cleaning blade 16.

As described above, in the case of the cleaning apparatus C in this embodiment, the rotational direction of the brush roller 60 in the interface between the image bearing member 15 and the brush roller 60 is opposite to the rotational direction of the image bearing member 15 in the interface between the image bearing member 15 and the brush roller 60, and the number of rotations of the brush roller 60 per unit of time is smaller than that of the image bearing member 15.

Therefore, as the residual toner t carried into the cleaning means container 14 by the image bearing member 15 reaches the interface between the image bearing member 15 and the brush roller 60, the residual toner t is scraped off by the pile portion 60P of the brush roller 60. However, it is impossible for the entire residual toner t on the image bearing member 15 to be removed by the pile portion 60P of the brush roller 60; most of the residual toner t is removed by coming in contact with the fiber of the pile portion 60P. Therefore, the amount of the residual toner t which reaches the cleaning blade 16 is reduced by the presence of the brush roller 60. Thus, the residual toner t which reaches the cleaning blade 16 is completely removed by the cleaning blade 16. Further, since the brush roller 60 rotates slower in terms of the number of the rotations per unit of time than the image bearing member 15, and also rotates opposite to the image bearing member 15 in terms of the rotational direction in the interface between the brush roller 60 and the image bearing member 15, the efficiency with which the brush roller 60 scrapes off the residual toner t from the image bearing member 15 is enhanced. Further, being smaller in terms of the number of rotations per unit of time, the brush roller 60 does not place an excessive amount of load on the driving force transmission gear train within the drum cartridge 13, extending the service life of the drum cartridge 13.

Also in the case of the cleaning apparatus C in this embodiment, in order to place the flexible sheet 16 in contact with the brush roller 60, the flexible sheet 16 is extended in the direction opposite to the rotational direction of the brush roller 60. The contact angle of the flexible sheet 61 relative to the line TL drawn tangential to the theoretical circumference of the brush roller 60 through the intersection between the flexible sheet 61 and the theoretical circumference of the brush roller 60 is smaller than 45 deg. In addition, the amount δs of the theoretical invasion of the flexible sheet 61 into the brush roller 60 in the radial direction of the brush roller 60 is greater than the amount δd of the theoretical invasion of the brush roller 60 into the image bearing member 15.

Since the flexible sheet 16 is extended in the direction opposite to the rotational direction of the brush roller 60, and the amount δs of the theoretical invasion of the flexible sheet 61 into the brush roller 60 is set to be greater than the amount δd of the theoretical invasion of the brush roller 60 into the image bearing member 15, the residual toner t is prevented from accumulating in the pile portion 60P of the brush roller 60 which is rotating at a smaller revolution than the image bearing member 15, and therefore, the diameter of the apparent core portion of the brush roller 60 is prevented from being increased by the accumulation of the residual toner t in the gaps among the fibers in the pile portion 60P. In other words, the load placed by the brush roller 60 is prevented from fluctuating. Thus, the residual toner t on the image bearing member 15 is efficiently scraped off by the pile portion 60P of the brush roller 60. Further, since the amount δs of the theoretical invasion of the flexible sheet 61 into the brush roller 60 is set to be greater than the amount δd of the theoretical invasion of the brush roller 60 into the image bearing member 15, the damage caused to the image bearing member 15 as the brush roller 60 rotates in contact with the image bearing member 15 is minimized, prolonging the service life of the image bearing member 15.

Further, in the case of the cleaning apparatus C in this embodiment, the brush roller 60 comprises the metallic brush shaft 60S, and the pile portion 60P. The pile portion 60P is composed of electrically conductive fiber and wrapped around the brush shaft 60S. Also, the brush shaft 60S is electrically connected to the metallic grounding plate 66 through the electrically conductive coil spring 65 placed, in a slightly compressed state, between one of the longitudinal ends of the brush shaft 60, that is, the end on the driving side, and the metallic grounding plate 66.

Since the pile portion 60P composed of electrically conductive fiber is grounded as described above, the electrical charge which the residual toner t on the brush roller 60 accumulates is discharged, and the residual toner t on the brush roller 60 is effectively scraped away from the brush roller 60. Further, since the coil spring 65 is employed as the rotative and sliding contact member for electrically connecting the brush roller 60 to the metallic grounding plate 66, good electrical conductivity is assured. In addition, the resiliency of the coil spring 65 presses the other longitudinal end, that is, the nondriving end, of the brush shaft 60S against the bearing 67, accurately positioning the brush roller 60 in the process cartridge 13. Therefore, it is assured that the image bearing member 15 is desirably cleaned.

As is evident from the above description, the cleaning apparatus C in this embodiment can maintain its peak cleaning performance for a long period of time even when microscopic spherical toner is employed as developer. In addition, it can clean the image bearing member 15 for a long period of time without placing an excessive amount of load on the gear train within the drum cartridge 13 removably installable in the main assembly A of an image forming apparatus, and also can store a large amount of the residual toner t. Therefore, it is possible to extend the interval at which the drum cartridge 13 must be replaced by a user, and also to provide a drum cartridge which can be easily replaced by a user without making the hands dirty.

[Other Embodiment]

In the preceding description of the embodiments of the present invention, the present invention was described with reference to the cleaning apparatus C placed in the drum cartridge 13 which comprises the image bearing member 15 as an electrophotographic photosensitive member. However, the present invention is also applicable to a cleaning apparatus which is directly placed in an electrophotographic or electrostatic image forming apparatus in which an image bearing member, a cleaning means for the image bearing member, and the like members, are directly mounted in the main assembly of the image forming apparatus instead of being placed in a process cartridge (drum cartridge 13) removably installed in the main assembly of an image forming apparatus.

An electrophotographic photosensitive member to be placed in a process cartridge (drum cartridge 13) does not need to be limited to a member such as the image bearing member 15 in the preceding embodiment; the following may be employed. For example, as for photosensitive substance, any photoconductive substance may be employed, for example, amorphous silicon, amorphous selenium, zinc oxide, titanium oxide, organic photoconductor, and the like. As for the shape of a base member on which the photosensitive substance is carried, a base member may be in the form of a drum or belt. In the case of a photosensitive member in the form of a drum, that is, a photosensitive drum, it is manufactured by depositing or coating photoconductive substance on the peripheral surface of a cylinder formed of aluminum alloy or the like.

Also in the case of the preceding embodiment of the present invention, the charging means 17 was based on the so-called contact-type charging method. However, the present invention is obviously also compatible with methods other than the above described one. For example, there is a conventional charging method, according to which a piece of tungsten wire is surrounded on three sides by a shield formed of metallic material such as aluminum, and the peripheral surface of an image bearing member is uniformly charged by transferring positive or negative ions generated by applying high voltage to the tungsten wire, onto the peripheral surface of the image bearing member.

The shape of the charging means may be in the form of a blade (charge blade), a pad, a block, a rod, a wire, or the like, in addition to the above described roller.

As for the component which constitutes the cleaning member for removing the residual toner on the image bearing member, a magnetic brush or the like may be used in place of the cleaning blade 16.

The process cartridge (drum cartridge 13) referred to in the preceding description of the embodiment of the present invention comprised the image bearing member 15 as an electrophotographic photosensitive member, the charging means 17 and cleaning means (cleaning apparatus C), which both act upon the image bearing member 15. However, the present invention is also compatible with a cartridge which integrally comprises an image bearing member as a member for bearing a toner image, and a cleaning means (cleaning apparatus C), and which is removably installable in the main assembly of an image forming apparatus.

Further, in the preceding description of the embodiment of the present invention, a color laser printer was referred to as an electrophotographic image forming apparatus. However, the application of the present invention does not need to be limited to a color laser printer; the present invention is obviously also compatible with image forming apparatuses other than a color laser printer, for example, electrophotographic copy machines, facsimile machines, word processors, and the like.

As for the recording sheet as recording medium, a sheet of plastic material such as an OHP sheet or the like, or a sheet of cloth, is usable in addition to a sheet of ordinary recording paper.

Also in the preceding description of the embodiment of the present invention, the image bearing member was described as an electrophotographic photosensitive member. However, the application of the present invention does not need to be limited to an electrophotographic photosensitive member; the present invention is compatible with many other image bearing members, for example, any member capable of bearing a toner image, such as the intermediary transferring member mentioned in the preceding description of the embodiment of the present invention.

While the invention has been described with reference to the structures disclosed herein, it is not confined to the details set forth and this application is intended to cover such modifications or changes as may come within the purposes of the improvements or the scope of the following claims.

What is claimed is:

1. A cleaning apparatus comprising:

a brush roller, contactable to an image bearing member, for removing toner from the image bearing member;

a brush driving force transmission path, which is different from a driving force transmission path for the image bearing member;

wherein said brush roller is rotated through said brush driving force transmission path with a speed of rotation smaller than that of the image bearing member, wherein a rotational direction of said brush roller is such that a direction of peripheral movement of the brush roller is opposite from that of the image bearing member at a position where the image bearing member and said brush roller contact each other, wherein a brush of said brush roller includes a pile of electroconductive fibers;

a blade member contactable to the image bearing member downstream of said brush roller with respect to a rotational direction of the image bearing member; and a scraping member, contacting said brush roller, for scraping toner from a brush of said brush roller, wherein a position of contact between said scraping member and said brush roller is upstream of a position where said scraping member is fixed, with respect to a rotational direction of said brush roller, and wherein an entering distance of said scraping member into said brush roller is larger than that of said brush roller into the image bearing member, wherein the number of revolutions per unit time of said brush roller is smaller than that of said image bearing member.

2. A cleaning apparatus comprising:

a brush roller, contactable to an image bearing member, for removing toner from the image bearing member;

wherein a rotational direction of said brush roller is such that a direction of peripheral movement of the brush roller is opposite from that of the image bearing member at a position where the image bearing member and said brush roller contact each other;

wherein the number of revolutions per unit time of said brush roller is smaller than that of said image bearing member.

3. An apparatus according to claim 2, further comprising a first drive transmission path for rotating said brush roller, which is different from a second drive transmission path for rotating said image bearing member.

4. An apparatus according to claim 3, further comprising transporting means for transporting the toner removed by said brush roller, and said first drive transmission path is effective to drive said transporting means.

5. An apparatus according to claim 2, further comprising a blade member contactable to the image bearing member downstream of said brush roller with respect to a rotational direction of the image bearing member.

6. An apparatus according to claim 2, further comprising a scraping member, contacting said brush roller, for scraping toner from a brush or said brush roller.

7. An apparatus according to claim 6, wherein a position of contact between said scraping member and said brush roller is upstream of a position where said scraping member is fixed, with respect to a rotational direction of said brush roller.

8. An apparatus according to claim 7, an angle formed between a tangent line of said brush roller at a contact point between said scraping member to said brush roller and said scraping member is smaller than 45° at a downstream side with respect to a peripheral movement direction of said brush roller.

9. An apparatus according to claim 6, 7, and 8, wherein an entering distance of said scraping member into said brush roller is larger than that of said brush roller into the image bearing member.

10. An apparatus according to claim 6, wherein said scraping member is a flexible sheet.

11. An apparatus according to claim 2, wherein a brush of said brush roller includes a pile of electroconductive fibers, wherein an end of a rotational shaft of said brush roller is electrically grounded through a spring.

12. An apparatus according to claim 2, wherein said cleaning apparatus is provided in a process cartridge detachably mountable to a main assembly of an image forming apparatus together with said image bearing member.

13. An apparatus according to claim 2, wherein said cleaning apparatus is provided in said image forming apparatus together with said image bearing member.

* * * * *

UNITED STATES PATENT AND TRADEMARK OFFICE

CERTIFICATE OF CORRECTION

PATENT NO. : 6,314,266 B1
DATED : November 6, 2001
INVENTOR(S) : Kazunari Murayama et al.

It is certified that error appears in the above-identified patent and that said Letters Patent is hereby corrected as shown below:

Column 1,
Line 37, "an" should read -- the --.

Column 2,
Line 26, "Patent Japanese" should read -- Japanese Patent --.
Line 34, "transmitting" should read -- transmitted --.

Column 5,
Line 39, "sleeve YS," should read -- sleeve 20YS --.
Line 62, "from" should read -- four --.

Column 11,
Line 42, "sheet 16" should read -- sheet 61 --.
Line 43, "sheet 16" should read -- sheet 61 --.
Line 55, "sheet 16" should read -- sheet 61 --.

Column 13,
Line 14, "above described" should read -- above-described --.

Column 14,
Line 15, "other," should read -- other, and --.
Line 26, "and" should be deleted.
Line 29, "member," should read -- member, and --.
Line 40, "other," should read -- other, and --.
Line 64, "an" should read -- wherein an --.

Column 15,
Line 5, "and" should read -- or --.

Signed and Sealed this

Twenty-first Day of May, 2002

*Attest:*

*Attesting Officer*

JAMES E. ROGAN
*Director of the United States Patent and Trademark Office*